United States Patent [19]

Goldstein

[11] 3,950,848

[45] Apr. 20, 1976

[54] SAFETY RAZOR

[76] Inventor: Michael Goldstein, 11810 Mayfield, Los Angeles, Calif. 90049

[22] Filed: Mar. 18, 1974

[21] Appl. No.: 441,007

[52] U.S. Cl. ..... 30/47; 30/89

[51] Int. Cl.[2] ..... B26B 21/14

[58] Field of Search ..... 30/38, 47, 57, 85, 87, 30/89, 44, 45

[56] References Cited

UNITED STATES PATENTS

| | | | |
|---|---|---|---|
| 614,049 | 11/1898 | Greenfield | 30/87 X |
| 1,175,023 | 3/1916 | Szabo | 30/44 X |
| 2,844,870 | 7/1958 | Roces | 30/85 |
| 3,685,150 | 8/1972 | Risher | 30/89 |
| 3,740,841 | 6/1973 | Risher | 30/89 X |
| 3,768,162 | 10/1973 | Perry | 30/85 X |

*Primary Examiner*—Al Lawrence Smith
*Assistant Examiner*—Gary L. Smith
*Attorney, Agent, or Firm*—Gardner and Anten

[57] ABSTRACT

A safety razor comprising a razor blade support member connected to a handle through a linkage assembly is disclosed. The linkage assembly maintains the angle of the razor blade support member in relation to the handle at substantially a constant angle to prevent the razor blade from moving in a circular path. The razor blade support member is spring biased and retracts responsive to pressure being applied to it by the force during shaving, and maintains the pressure applied by the safety razor upon the face constant. The spring biasing means associated with the linkage assembly may be adjusted to vary the applied pressure.

15 Claims, 9 Drawing Figures

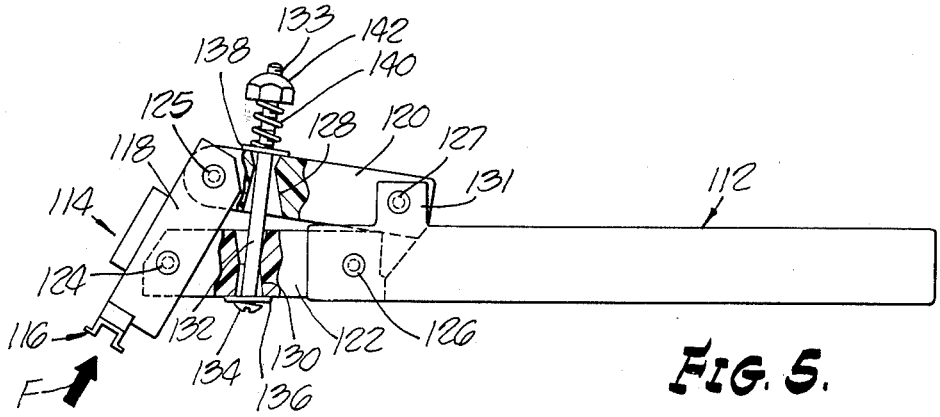
FIG. 5.
FIG. 6.
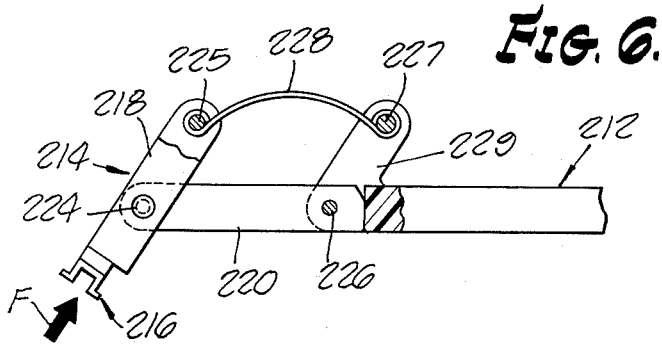
FIG. 8.
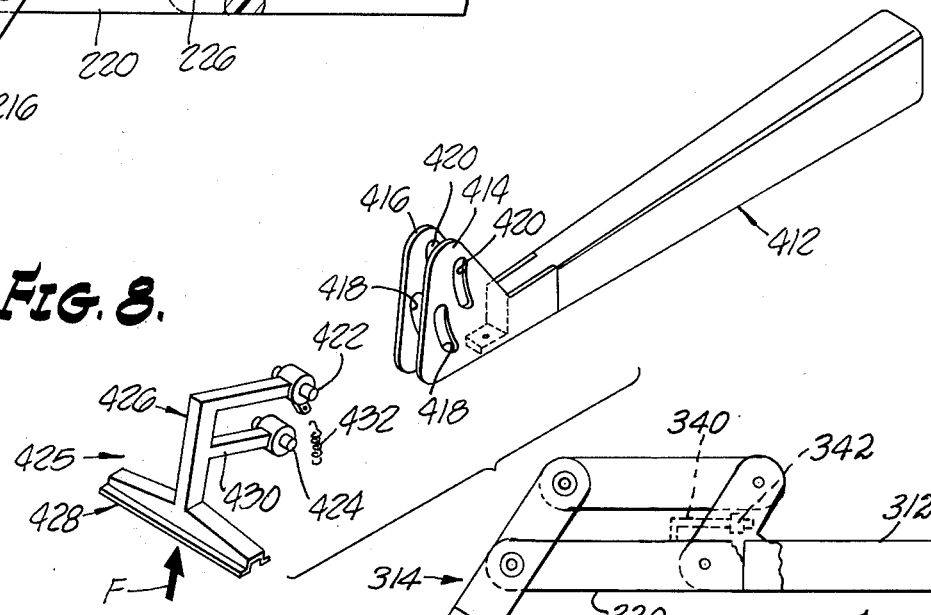
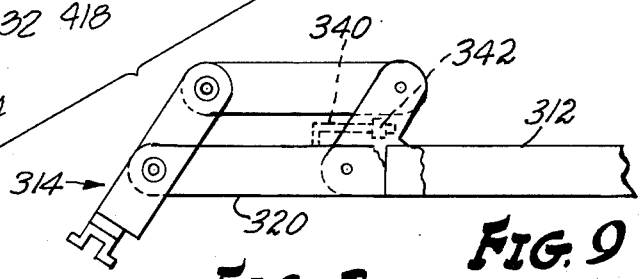
FIG. 9
FIG. 7.
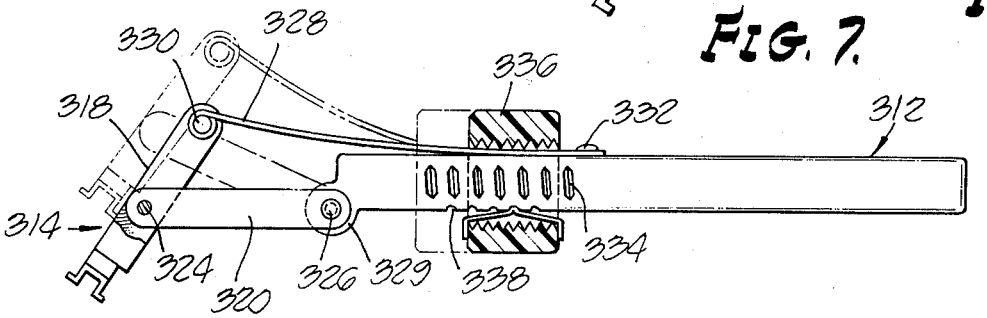

SAFETY RAZOR

BACKGROUND OF THE INVENTION

The present invention relates to an improved safety razor in which the pressure applied to the skin of the user is reduced, resulting in less skin irritation, while at the same time providing an improved shave. This is achieved by maintaining the razor blade in contact with the skin at substantially a constant angle despite retraction of the razor blade support member in response to increased skin pressure upon the razor during shaving.

Safety razors have long been used and its introduction represented a great improvement over the previously available straight razors which were difficult to use and resulted in irritation and cuts to the face of the user. Also, the straight razors had to be repeatedly sharpened, a difficult task. In addition, the great mass of the straight razor as well as its unwieldy size, despite some attempts to reduce both its size and mass, were substantial impediments to preventing severe skin irritation and cuts during shaving.

With the advent of the safety razor, with the replaceable thin blade, many of the disadvantages of the previously available straight razor were eliminated. The safety razor employed a guard upon which the razor blade itself rested. The guard served to push the skin downward, elevating the wisker for preparation for its being cut off by the razor blade supported on top of the guard. At the same time, the guard served to maintain the razor blade away from the skin, provided, however, that the guard and the razor were maintained in proper position in relation to the surface of the skin during shaving.

Despite the great advancement that the safety razor represented over the straight edge razor, it was soon discovered not to be the ultimate in shaving equipment. Inexperienced shavers still had difficulties in maintaining the guard of the razor blade in the proper relationship with the face during shaving. This was particularly true around the ridges of the jaw and over the soft skin of the neck in the area of the larynx.

An additional major disadvantage of the previously available safety razors is that if the person being shaved, such as an invalid, a patient or a customer in a barber shop, is being shaved by someone else, it is extremely difficult to gauge the pressure which is being applied to the surface of the skin. Invariably, the ability to shave such another person requires extended periods of trial and error before the shaving operation is satisfactorily performed.

Further, the previously available safety razors were difficult and dangerous for persons not having adequate motor control of their hand and wrist; for example, older persons whose hands may tremble and jerk during the shaving operation.

In response to these deficiencies a multitude of proposed improvements for instruments for shaving have been promulgated, including, of course, the introduction of the electric razor. The electric razor, which was heralded as the ultimate shaving device, has yet to achieve the unanimous approval of the shaving public. The electric shaver is difficult to use when the face is moist, is not readily adaptable to the skin and whisker pattern of many users, and represents, comparatively, an expensive investment. Also, the electric shaver uses electric power which many times is unavailable at the locations at which a shave might be desired.

Many of these "improved" devices included means for overcoming the primary remaining disadvantages of the safety razor. The first of these disadvantages, maintaining the guard and blade in a proper relationship to the face, was attempted to be resolved by safety razors as disclosed in the patent to Trippe, U.S. Pat. No. 2,125,135 and Angst, U.S. Pat. No. 1,479,690. Both of these patents represented attempts to maintain the razor blade support head and thus the razor blade in a constant relationship to the surface of the face irrespective of the position of the handle. While such devices did maintain the guard and razor blade in a constant relationship with the face, they did not provide any means for maintaining a constant pressure on the face by the guard and blade during the shaving operation other than, of course, by control of the pressure applied to the handle by the hand and wrist.

The second recognized disadvantage of the standard safety razor was that it still failed to compensate for increased pressure of the guard and the razor on the face during different operations of shaving, so as to have a constant pressure applied to the face. The only means of controlling the pressure on the face was still the application of force applied to the handle by the hand and wrist.

Safety razors embodying the blade pressure control such as disclosed in the patent to Risher, U.S. Pat. No. 3,740,841 required the razor blade to pivot about a fixed point in an arc. Such movement of the razor blade is undesirable in that the angle between the blade and the face changes substantially during the shaving operation, thus exposing more of the guard and less of the razor blade itself to the face during the shaving operation. This will give an uneven shave as the razor support member swings an arc as it is brought across the surface of the face.

Other devices such as the safety razor disclosed in the patent to Sabiers, U.S. Pat. No. 2,059,172 also incorporated pressure responsive means for controlling the pressure of the safety razor upon the face during shaving as well as the positioning of the blade on the face. In the Sabiers safety razor, the razor blade moved in a longitudinal, up and down direction, depending on the pull on the blade as it is drawn across the face. The head was also rotatably mounted in the handle so that the head of the safety razor would lie flush along the surface to be shaved. The device of Sabiers, however, failed to recognize the fact that the pulling of the blade against the face to lift the head was in itself recognition of the undesirable pulling effect of the razor blade and merely stopped the shaving process until the limit of the movement of the handle was reached. By the time that the razor blade had resulted in a pulling motion sufficient to oppose the tension of the spring, the damage would have been done.

In addition, the safety razor of Sabier would not control the horizontal component of the pressure against the surface of the skin and at best would only compensate to a limited extent the vertical component of the pressure applied to the skin during shaving.

Also, previously available pressure responsive safety razors have failed to recognize that different portions of the face require different types of operation. For example, when one is shaving the sideburns, a ridged razor blade is preferable. However, during the shaving of the remainder of the face a pressure responsive razor blade is preferred. None of the previously available safety razors offered such versatility.

Each of the previously proposed safety razors, referred to above, generally involved a number of moving parts which required precise assembly for effective operation. Any such requirement would dramatically increase the price for such a safety razor, and consequently limit its acceptability by the public.

It is an object of the present invention to provide an improved safety razor which maintains a constant pressure on the face during shaving.

A further object of the present invention is to provide an improved safety razor which minimizes any possible skin irritation during shaving.

Another object of the present invention is to provide an improved safety razor which maintains the razor blade in contact with the face during retraction of the razor blade during shaving.

An additional object of the present invention is to provide an improved safety razor which has adjustable means for controlling the amount of pressure applied to the face during shaving.

A further object of the present invention is to provide an improved safety razor which will extend the life of the razor blade due to the decreased pressure applied against the blade by the face during the shaving operation.

Still another object of the present invention is to provide a safety razor which is light weight, compact and simple to control.

An additional object of the present invention is to provide an improved safety razor which may be used safely and accurately by users having imperfect motor control of their hands, particularly older persons.

A still further object of the present invention is to provide an improved safety razor which may be easily and safely used by one person to shave another person, such as an invalid or a person being prepared for an operation.

And still yet a further object of the present invention is to provide an improved safety razor which is inexpensive to manufacture and does not require detailed assembly.

A further object of the present invention is to provide an improved safety razor which has the capability of being rigid when areas such as the sideburns are trimmed and pressure responsive when being used over the remainder of the face.

Further additional objects of the present invention will become evident upon a study of the appended drawings and the accompanying detailed description of the preferred embodiment of the safety razor.

SUMMARY OF THE INVENTION

In the present invention an improved safety razor is disclosed which permits the razor blade to follow the skin surface by a retraction on maneuver once a certain level of pressure is placed on the razor blade. Thus, the pressure applied by the razor blade to the skin surface is maintained constant, despite variations in pressure applied to the handle during shaving, or the hitting of an obstruction.

By having the razor blade withdraw from the face after a certain force is reached, scraping of the skin surface is reduced, while at the same time the life of the razor blade is increased.

The directional movement of the razor blade support member, and consequently the razor blade, is controlled by a linkage assembly connecting the razor blade support member to the handle. A biasing element, such as a spring, acts upon the linkage assembly to control the amount of pressure which is required to displace the razor blade support member. In the preferred embodiment, the amount of tension applied to the linkage assembly by the biasing element may be varied by the user.

The linkage assembly for connecting the razor support member to the handle is of the type generally known as a parallel movement linkage and consists of a floating parallelogram configuration. Such a linkage imparts a noncircular movement to the head of the razor blade as the razor blade is retracted from the skin surface. In an exactly parallel linkage assembly, the head and following member of the razor blade, support member would maintain a fixed angle in relationship to the handle of the safety razor during all positions of the razor blade support member. However, in the preferred embodiment, it has been found that due to the changes of position of the handle required in shaving the neck and chin locations, it is preferred that the razor blade assume a more arcuate path of travel during the more advanced stages of retraction of the razor blade.

The noncircular movement of the head of the razor blade support member is achieved, in the preferred embodiment, by pivotably pinning one end of each linkage arm to the follower of the razor blade support member and the other end of each linkage arm to the handle of the safety razor, so that the two linkage arms are substantially parallel to one another. If the distance between the two pivot points on the follower arm and the two pivot points on the handle are the same, the angle between the razor blade support member and the handle will be maintained constant during withdrawal of the razor blade.

By having the distance between the two pivot points upon the handle slightly smaller than the distance between the two pivot points on the follower arm the result is an increasing angle between the follower arm of the razor blade support member and the handle during the more advanced stage of retraction. Such an increased angle is preferable for assisting in shaving around the neck and chin portion or other curved surface.

It is recognized that there are a number of parallel movement assemblies which could be employed to attach a razor blade support member to the handle and anyone of such movements could be employed to advantage in the present invention.

The tensioning element associated with the linkage assembly may be attached to a projection extending from one of the linkage arms and concealed within the handle of the safety razor. Such tensioning element would oppose any movement of the linkage member in the absence of the applied pressure at one end of the linkage arm. By increasing the tension upon the tension linkage arm, the amount of pressure which would be required to move the linkage assembly could be varied.

Also, a blocking element is incorporated in the handle of the safety razor for preventing the movement of the linkage assembly during shaving when retraction of the razor blade is desirable, such as when shaving the side burns. In the preferred embodiment, it is contemplated that a projection extends from the upper linkage arm which may be held in place by the user's finger. Since the force applied by the face during shaving is rather small, in the order of few grams, the pressure applied by the finger during shaving is quite sufficient to maintain the razor blade in fixed contact with the face and to overcome the retraction of the razor blade. However, in an alternative embodiment, a retractable pin may be used to fix a second point on the upper linkage arm to the handle preventing movement of the linkage assembly.

The operation of the pivot safety razor will become more apparent from the ensuing detailed description of the appended drawings.

In FIG. 1 a side view of the improved safety razor is shown with the retracted position of the razor blade support member shown in dotton lines;

In FIG. 2 a top view of the improved safety razor is shown.

In FIG. 3 a rear view of the improved safety razor is shown.

In FIG. 4 a side sectional view, taken along section lines 4—4 of FIG. 2 is shown.

In FIG. 5 a side partial sectional view of an improved safety razor with a modification tensioning element is shown.

In FIG. 6 a further modification of the improved safety razor is shown.

In FIG. 7 an additional embodiment of the improved safety razor with means of adjusting the spring constant of the tensioning elements is shown.

In FIG. 8, an exploded perspective view of a further modification of the improved safety razor is shown.

In FIG. 9, an additional embodiment of the approved safety razor with means of adjusting the spring tension is shown.

DESCRIPTION OF THE PREFERRED EMBODIMENT

Figure 1:
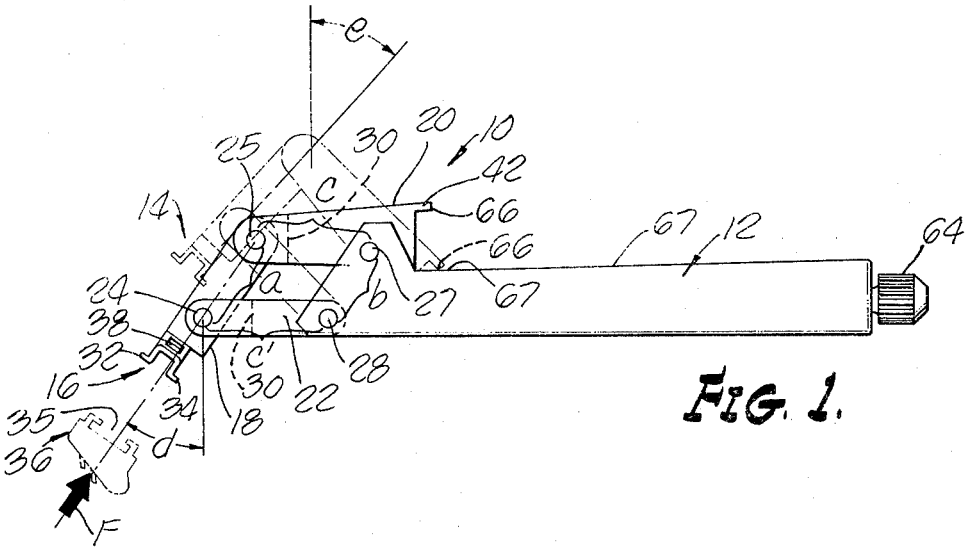

Referring to FIG. 1 of the drawings, a safety razor 10, preferably of a plastic material having a handle 12 and a razor blade support member 14 consisting of a head 16 and a following member 18 is shown. The following member 18 of the razor blade support member 14 is connected to the handle 12 through a linkage assembly consisting of linkage arms 20 and 21.

One end of each linkage arm 20 and 22 is pivotably connected to the following member 18 by rivets 24 and 25. The other end of each linkage arm 20 and 22 is pivotably mounted in a slot 26 in handle 12, shown in greater detail in FIG. 2 by rivets 27 and 28 so that the two linkage arms 20 and 22 are substantially parallel to one another. The distance *a* between rivets 24 and 25 fixing linkage arms 20 and 22 to the following member 18 of razor blade support member 14 is slightly greater than the distance *b* between rivets 27 and 28. The distance *c* between rivets 25 and 27 on linkage arm 20 is shorter than the distance *c'* between rivets 24 and 28 on linkage arm 22.

Figure 2:
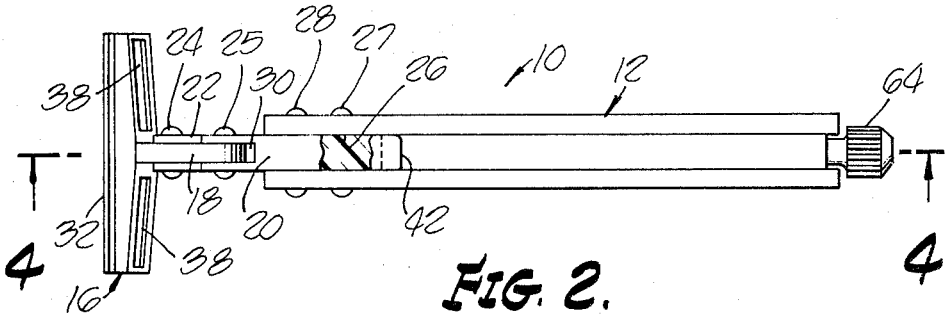
Figure 3:
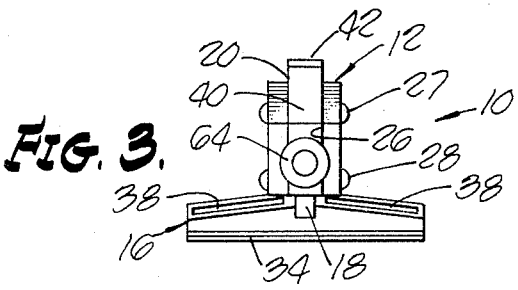

Following member 18 is fitted within slots 30 of the linkage arms 20 and 22, shown in greater detail in FIG. 2, to give greater stability to the position of the razor blade support member 14 during shaving. The other ends of the linkage arms 20 and 22 fit within the slot 26 in the handle 12 to support the linkage assembly.

The head 16 of the razor blade support member 14 connected to the following member 18 by epoxy is a U-shaped member having outwardly projecting ends 32 and 34 for associated with the groove 34 of a razor blade assembly 36 having a dual bladed system. Of course, the head 16 may be adapted for use with any razor assembly such as a single edge blade injection system.

The top surface of the head 16 has two lateral spaced openings 38 along its top surface to permit the flushing of water through the spaced openings 38 to clean the blades of the razor blade assembly during shaving. The angle *d* of the razor blade support member with the vertical, in the preferred embodiment, is approximately 45°, during its non-retracted position as shown in FIG. 1 by the solid line configuration buy may be set for any angle between approximately 35° to 55°.

Linkage arm 20 has a bulge 40 with an appendage 42 extending therefrom on the end of the linkage arm 20 attached to the handle 12. An eyelet pin 45 has its shaft 44 projecting into the bulge 40 of linkage arm 20. One end of a tension spring 50 is connected to the eye 52 of eyelet pin 46 and the other end of tension spring 50 is connected to an opening 54 in one end of non-rotating rider member 56 fitted within the hollow 48 of the hollow handle 12. The other end of the rider member has a threaded aperature 58 in it which receives a complimentary threaded shaft 60. The threaded shaft 60 projects through an opening 62 in the end wall of the hollow handle 12 where it is fixed to a knurled adjustment knob 64.

Figure 4:
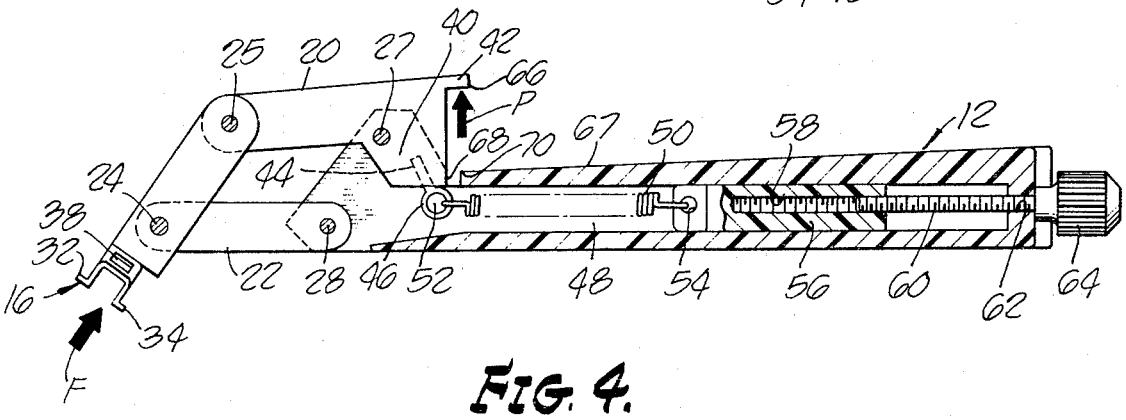

Turning of the knurled adjustment knob 64 will advance the threaded shaft 60 within the rider member 56 pulling the rider member 56 toward the adjustment knob 64, thereby stretching tension spring 50 and increasing the tension upon eyelet pin 46 attached to linkage arm 20. The increased tension upon eyelet pin 46 tends to pivot linkage arm 20 about rivet 27 in a counter-clockwise direction, as viewed in FIG. 4.

During the use of the safety razor 10 the razor blade assembly 36 is attached to the head 6 of the safety razor 10. Adjustment knob 64 is turned until the desired tension upon linkage member 20 is achieved. The tension desired will vary from user to user and each user will arrive at the preferred tension so as to give the user the best results.

When the razor blade assembly 36 is pressed against the skin surface, a pressure force "F" will be exerted upon it. Such pressure will attempt to overcome the force of tension spring 50 on linkage arm 20 to pivot linkage arms 20 and 22 about rivets 27 and 28 respectively, in a clockwise direction as viewed in FIG. 1.

As the tension on linkage arm 20 due to tension spring 50 is overcome by the force "F" applied to the razor blade assembly 36, razor blade support member 14 retracts as shown in FIG. 1 by the dotted lines. It is recognized that after a certain force "F" has been placed upon the razor blade assembly 36, the rear edge 66 of appendage 42 will abutt the top surface 67 of handle 12 preventing further retraction of the razor blade support member 14, consequently, causing the safety razor to operate as a fixed safety razor. However, this would not be a condition ordinarily present during shaving.

The linkage arms 20 and 22 are prevented from rotating in a counter-clockwise direction about rivets 27 and 28 further than the horizontal position by the abuttment of the rear edge 68 of linkage arm 20 with the edge 70 of the top surface 67 of the hollow handle 12. Since the distance from rivet 27 to the edge 70 of the top surface 67 of the handle 12 is greater at edge 68 than along the remainder of the rear edge of the linkage arm 20, there is interference with the pivotable clockwise rotation of linkage arm 20 during the shaving operation.

The direction of movement of the razor blade assembly 36 as it is retracted in response to force "F" from the skin surface is non-circular as would be the condition if the follower member 18 were connected to the handle 12 at only one pivot point. Since the distance between two points 24 and 25 on the following member 18 and two points 27 and 28 on the handle 12 must be maintained constant, no circular movement is possible. The head 16, the following member 18, and the razor blade assembly 36 retract along a non-circular path to the position shown in FIG. 1 by the dotted lines.

Referring to FIG. 1, it may be observed that the angle *e* approximately 60° between the center line of the following member in its fully retracted position and the vertical is slightly greater than the angle *d* approximately 40° which represented the angle between the center line of the following member 18 in its non-retracted position and the vertical. This increase is due to having the distance *a* between rivets 24 and 25 slightly greater than the distance *b* between rivets 27 and 28 on handle 12, and distance *c'* (24-28) greater than *c* (25–27).

Were the distances *a*, *b* and *c* and *c'* fixed so as to equal one another, then the angle *d* and the angle *e* would be equal for all locations of the razor blade support member 14 between the non-retracted position of the razor blade support member 14 and the fully retracted position of the razor blade support member 14. It has been found, however, that maintaining the angle of the razor blade support member 14 constant is not preferable. When shaving in the vicinity of the neck and chin, a substantial change in the position of the razor blade assembly 36 in relation to the face is required. By having the angle *e* increase during the latter stages of retraction, as is most likely to occur when shaving the neck and the chin areas, the needed changes in the position of the razor blade assembly 36 is compensated for.

When it is desired to shave the side burn area and perhaps the area ajacent to the nose, the second finger of the user is placed beneath appendage 42 of linkage member 20. The applying of pressure "P", as shown by the arrow in FIG. 4, will prevent the movement of linkage member 20 and the razor blade support member 14. After shaving side burn or nose area the finger is removed and the safety razor will again operate so as to apply constant pressure to the face during shaving.

In FIG. 5, a modification of the present invention is disclosed. Referring to FIG. 5, a solid handle 112 is connected to a razor blade support member 114 consisting of a head 116 attached to a following member 118 by linkage arms 120 and 122. One end of linkage arm 120 is pivotably connected to the following member 118 by rivet 125 and to an ear 131 on the handle 112 by rivet 127. One end of linkage member 122 is connected to following member 118 by rivet 124 and to the handle 112 by rivet 126 so that the linkage arms 120 and 122 form a relatively small angle to one another.

Linkage arms 120 and 122 have aligned aperatures 128 and 130 having the shape of intersecting truncated cones. A smooth shaft 132 threaded at one end having a head 134 resting on washer 136 is fitted through the two-alligned aperatures 128 and 130. Supported on washer 138 is tension spring 140 fitted around the shaft 132. A threaded nut 142 fits over the threaded end 133 of the smooth-surfaced shaft to compress the tension spring 140.

The biasing of tension spring 140 tends to maintain linkage arms 120 and 122 together and opposes their movement to separate. When force "F" is applied to the head 116 of the razor blade support member 114 by the skin the force tends to try to pivot linkage arms 120 and 122 about rivets 127 and 126 respectively, thus increasing the space between linkage members 120 and 122.

It is recognized that there are a number of different methods for tensioning the linkage arms so as to oppose the movement of the razor blade support member 14. For example, an elastic substance such as a rubber band joining or connecting both linkage members together could be used to restrict their movement. Any such means is contemplated as being within the concept of the disclosed invention.

In FIG. 6 a further simplified non-adjustable safety razor embodying the concept of the present invention is disclosed.

A handle 212 is connected to a razor blade support member 214 having a head 216 and a following member 218 by a linkage arm 220 fixed at one end to the following member 218 by rivet 224 and to the handle 212 at the other end by rivet 226. A short outwardly bowed spring band 288 of steel or other material forms the second linkage member of the safety razor. One end of the spring band 228 is pivotably riveted to the following member 218 by rivet 225 and the other end is fixed to ear 229 by rivet 227.

As force "F" is applied to the razor blade support member 214 during shaving the spring band 223 is pivoted about fixed rivet 227 as the razor blade support member 214 retracts. However, the spring band 228 being fixed at rivet 227 opposes such movement of the razor blade support member 214. Upon removal of force "F" the linkage arm 220 will be returned to its initial position.

The embodiment of the invention illustrated in FIG. 6, described above, represents a form of the present invention which is extremely inexpensive to manufacture. However, it must be recognized that it does not have provisions for adjusting the pressure of the safety razor against the skin.

Referring to FIG. 7, a further modification of the safety razor shown in FIG. 6 is shown, which illustrates various means of adjusting the pressure of the safety razor on the face.

As described above in reference to FIG. 6, a handle 312 is connected to a razor blade support member 314 by a linkage arm 320 pivotably riveted at one end to follower member 318 by rivet 324 and at its other end to an ear 329, projection from the end of handle 312 by rivet 326. Again, a spring steel band, 328 forms the second linkage arm between the handle 312 and the razor blade support member 314. One end of the spring band 328 is pivotably riveted by rivet 330 to the following member 318 and its other end fixed to the handle by rivet 332. A portion of the handle 312 has a threaded portion 334 along its outside surface. A nut 336 fits over the threaded portion 334 of handle 312 pinning a portion of the spring steel band 328 between the nut 336 and the handle 312.

During shaving, the application of a force "F" against the razor blade support member 314, as described above in reference to FIG. 6, will pivot the fixed end of the spring band 328 which is pinned to the handle 312 in a clockwise direction as shown. This movement will be opposed by the opposing tension of spring steel band

328.

By advancing the nut 336 along the threaded portion 334 of the handle to the position shown in the dotted lines in FIG. 7, the effective length of the spring band 328 will be shortened, thereby increasing the tension of spring steel band 328 applicable against the movement of the razor blade support member 314.

Instead of having a threaded portion on the handle 312, it is possible that a series of detents 338 could be placed on the handle 312. The nut 336 having complimentary detent fittings would slide along the handle 312 still pinning the spring steel band 328 between the nut 336 and the handle 312, and engage the detent slots 338 to fix the position of the nut.

The drawings in the foregoing description illustrate various embodiments of the concept of the present invention and it will be apparent that other embodiments may be made, such as the placements of the tensioning springs or the precise movement of the razor blade support member, without departing from the present invention.

Another type of element for adjusting the pressure is an elastic or pliable protuberance 340, such as shown in FIG. 9 in the dotted lines, which rests against the lower linkage member 320. As the linkage member 320 is pivoted about rivet 326 it must overcome the spring tension of the protuberance. By increasing the length of the protuberance 340, by turning threaded knob 342, the spring tension which must be overcome thereby decreases.

Referring to FIG. 8, a further simplified modification of the improved safety razor of the present invention is shown.

A handle 412 has two opposing parallel spaced apart plates 414 and 416 fixed at one end. Each plate 414 and 416 has a pair of guide tracks 418 and 420 spaced from one another. One of the guide tracks 418 is lower than the other guide track 420.

A combination razor blade support member and linkage assembly 425 comprises an "F" shaped member 426 having a head 426 fixed to the base of the "F". One of the legs 428 of the linkage assembly is shorter than the other leg 430.

Projection pins 422 and 424 extend perpendicularly from the ends of the legs 428 and 430 and fit within the guide slots 418 and 420. In an alternative embodiment, the projection pins could enter from the razor blade support member itself, this eliminating the requirement of legs 428 and 430.

The movement of the head 428 is thus limited to the direction of the path formed by the attached "F" shaped member 426 which is guided by tracks 418 and 420. The shape of the guide tracks 418 and 420 may be varied to obtain the desired characteristics, referred to above in describing the illustration of FIG. 1.

A tensioning spring 432 is connected to leg 428 of the F-shaped member 426 with its other end connected to the lower edge of handle 412. Thus, in the absence of any force being applied against the head 416 the tensioning spring 428 will hold the linkage assembly 425 at the bottom of the guide tracks 418 and 420.

When a force "F" is applied to the head 428 of the safety razor the tensioning spring 432 will maintain a constant pressure on the skin during shaving.

I claim:

1. A safety razor for retaining a razor blade comprising:

a. a handle;

b. a razor blade support member for supporting said razor blade with the center line of said razor blade substantially perpendicular to the center line of said handle;

c. means for connecting said razor blade support member to said handle, the razor blade support member being movable in relation to the handle in a non-circular path between a first position, in the absence of pressure on said razor blade, and a second position, in the presence of pressure on said razor blade; and d. biasing means for urging said razor blade support member to its said first position;

e. said means for connecting said razor blade support member to said handle comprises a linkage assembly, said linkage assembly comprising two linkage arms having two ends, one end of each of said linkage arms being pivotably connected to said razor blade support member and the other end of each of said linkage arms being pivotably connected to said handle.

2. The safety razor of claim 1 wherein the distance between the pivot points of the ends of said linkage arms pivotably connected to said razor blade support member equals the distance between the pivot points of the ends of said linkage arms pivotably connected to said handle.

3. The safety razor of claim 1 in which the distance between the pivot points pivotably connecting said first linkage arm to said razor blade support member and to said handle equals the distance between said pivot points pivotably connecting said second linkage arm to said razor blade support member and to said handle.

4. The safety razor of claim 1 in which said first and said second linkage arms are parallel to one another.

5. The safety razor of claim 1 comprising means for restraining movement of said razor blade support member from said first position to said second position in response to pressure applied to said razor blade.

6. The safety razor of claim 5 in which said restraining means comprises a projection on one of said linkage arms, said projection overlapping said handle whereby pressure applied on said projection restrains movement of said linkage arm and said razor blade support member.

7. A safety razor for retaining a razor blade comprising:

a. a handle;

b. razor blade support member for supporting said razor blade with the center line of said razor blade substantially perpendicular to the center line of said handle;

c. means for connecting said razor blade support member to said handle, the razor blade support member being movable in relation to the handle in a non-circular path between a first position, in the absence of pressure on said razor blade, and a second position, in the presence of pressure on said razor blade; and d. biasing means for urging said razor blade support member to its said first position;

e. said razor blade support member is movably connected to said handle by a linkage assembly, said linkage assembly comprising two linkage arms having two ends, one end of at least one of said linkage arms being pivotably connected to said razor blade support member and said other end of said linkage arm being pivotably connected to said handle.

8. The safety razor of claim 7 in which one of said linkage arms comprises said means for urging said razor blade support member to its said first position.

9. The safety razor of claim 8 in which said linkage arm comprising said biasing means comprises a spring steel band one end of said spring steel band connected to said razor blade support member and the other end of said spring steel band connected to said handle.

10. The safety razor of claim 9 comprising means associated with said handle for varying the effective length of said spring steel band.

11. The safety razor of claim 8 comprising means for varying the spring tension of said linkage arm comprising said means for urging said razor blade support member to its said first position.

12. A safety razor for retaining a razor blade comprising:

a. a handle;

b. a razor blade support member for supporting said razor blade with the center line of said razor blade substantially perpendicular to the center line of said handle;

c. means for connecting said razor blade support member to said handle, the razor blade support member being movable in relation to the handle in a non-circular path between a first position, in the absence of pressure on said razor blade, and a second position, in the presence of pressure on said razor blade; and d. biasing means for urging said razor blade support member to its said first position;

e. said razor blade support member comprises a following member and a head member, the center line of said head member being perpendicular to the center line of said following member, the angle between the center line of the following member and the center line of the handle remains constant as the razor blade support member moves from its said first position to its said second position.

13. A safety razor comprising:

a. a handle;

b. a razor blade support member for supporting a razor blade;

c. means for movably connecting said razor blade support member to said handle;

d. said razor blade support member movable in a non-circular path between a first position and a second position;

e. said razor blade support member movable in response to pressure applied to said razor blade whereby said razor blade support member is moved in the direction of said force from said first position to said second position;

f. means for biasing said razor blade support member toward said first position;

g. said razor blade support member comprises an inverted T-shaped member having a central member and a bottom member, the longitudinal axis of said bottom member, the longitudinal axis of said bottom member being perpendicular to the longitudinal axis of said handle;

h. said angle between the center line of the handle and the center line of the central member changes from about 40 degrees when said razor blade support member is in its said first position to about 60 degrees when said razor blade support member is in its said second position.

14. The safety razor of claim 13 in which the rate of change of the angle between the center line of the handle and the center line of the central member increases as the razor blade support member is moved from its said first position to its said second position.

15. A safety razor comprising:

a. a handle;

b. a razor blade support member for supporting a razor blade;

c. means for movably connecting said razor blade support member to said handle;

d. said razor blade support member movable in a non-circular path between a first position and a second position;

e. said razor blade support member movable in response to pressure applied to said razor blade whereby said razor blade support member is moved in the direction of said force from said first position to said second position;

f. means for biasing said razor blade support member toward said first position;

g. said razor blade support member comprises an inverted T-shaped member having a central member and a bottom member, the longitudinal axis of said bottom member being perpendicular to the longitudinal axis of said handle;

h. said angle between the center line of the handle and the center line of the central member remains constant as said razor blade support member moves from its said first position to its said second position.

* * * * *